US009962722B1

(12) United States Patent
Sute

(10) Patent No.: US 9,962,722 B1
(45) Date of Patent: May 8, 2018

(54) PAINT CIRCULATION SYSTEM

(71) Applicant: GM Global Technology Operations LLC, Detroit, MI (US)

(72) Inventor: James M. Sute, Trenton, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days. days.

(21) Appl. No.: 15/333,813

(22) Filed: Oct. 25, 2016

(51) Int. Cl.

| | |
|---|---|
| ***B05C 5/02*** | (2006.01) |
| ***B05B 9/04*** | (2006.01) |
| ***B05B 12/08*** | (2006.01) |
| ***B05B 13/02*** | (2006.01) |
| ***B05B 13/04*** | (2006.01) |
| ***B05C 11/10*** | (2006.01) |
| *B05C 9/04* | (2006.01) |
| *B05C 15/00* | (2006.01) |

(52) U.S. Cl.
CPC ..... *B05B 9/0423* (2013.01); *B05B 12/085* (2013.01); *B05B 13/0221* (2013.01); *B05B 13/0431* (2013.01); *B05C 5/0216* (2013.01); *B05C 5/0225* (2013.01); *B05C 5/0237* (2013.01); *B05C 11/1002* (2013.01); *B05C 11/1026* (2013.01); *B05C 11/1036* (2013.01); *B05C 11/1039* (2013.01); *B05C 11/1044* (2013.01); *B05B 15/25* (2018.02); *B05B 16/00* (2018.02); *B05B 16/90* (2018.02); *B05C 9/04* (2013.01); *B05C 15/00* (2013.01); *Y10S 901/43* (2013.01)

(58) Field of Classification Search
CPC ... B05B 9/0423; B05B 13/0431; B05B 15/12; B05B 13/0221; B05B 12/085; B05B 15/003; B05B 15/25; B05B 16/00; B05B 16/90; B05C 5/0225; B05C 5/0237; B05C 5/0216; B05C 9/04; B05C 11/1002; B05C 11/1026; B05C 11/1036; B05C 11/1039; B05C 11/1044; B05C 15/00; Y10S 901/43
USPC ..... 118/323, 324, 326, 600, 602, 612; 901/43; 222/63, 333, 334, 318, 380, 390; 454/50
See application file for complete search history.

(56) References Cited

U.S. PATENT DOCUMENTS 4,564,410 A * 1/1986 Clitheros ..... B05C 5/0216 118/323
4,637,547 A * 1/1987 Hiniker ..... A01M 7/0089 239/1
5,305,917 A * 4/1994 Miller ..... B01F 15/0237 222/137

(Continued)

*Primary Examiner* — Laura Edwards

(57) ABSTRACT

A paint circulation system includes a paint reservoir, a pressure transducer, a servo motor driven pump, an electronic servo drive and controller, one or more paint applicators in a spray booth and an isolation valve. The pressure transducer provides a signal to the controller indicating the current pressure in the system. The servo pump is controlled by the controller and servo drive, draws paint from the reservoir and maintains the desired pressure in the system. The isolation valve is downstream from the applicators and is closed when paint is requested by the applicators. When paint is flowing to the applicators, the servo drive adjusts pump speed to maintain the desired system pressure as sensed by the pressure transducer. When paint is not requested, the isolation valve is open and the servo pump motor operates to provide a minimum flow rate to circulate paint from, and return it to, the reservoir.

18 Claims, 3 Drawing Sheets

(56) References Cited

U.S. PATENT DOCUMENTS

| | | | | |
|---|---|---|---|---|
| 5,485,941 | A * | 1/1996 | Guyomard | B29B 7/7615 222/1 |
| 5,533,341 | A * | 7/1996 | Schvester | B65B 31/006 422/28 |
| 6,521,187 | B1 * | 2/2003 | Papen | B01L 3/0268 222/263 |
| 8,333,164 | B2 * | 12/2012 | Herre | B05B 5/1675 118/302 |
| 2012/0247665 | A1 * | 10/2012 | Varga | B05C 5/001 156/304.2 |

* cited by examiner

PAINT CIRCULATION SYSTEM

INTRODUCTION

The present disclosure relates to a system for circulating paint utilized in vehicle spray booths and more particularly to a system for circulating paint utilized in vehicle spray booths incorporating servo motor driven pumps.

The following statements merely provide background information related to the present disclosure and may or may not constitute prior art.

Paint systems for supplying paint to vehicle spray booths are highly specialized systems comprehending multiple color paint supplies, pressure and flow control equipment, robotic applicators and rinse fluids for color changes. Typically, a system will include a multiple horsepower alternating current motor that drives a circulation pump through a gear reduction. Whether paint is being utilized or not, it is continuously circulated through the system as if it were and the pressure in the system is maintained by a back pressure regulator.

This system has several disadvantages. First of all, since such motors cannot operate in a stall condition without overheating, they must operate continuously which means that paint must flow continuously around the flow circuit. This, in turn, can cause degradation of the paint as it experiences shear while passing through the system, particularly the back pressure regulator. Another consequence of the inability of such motors to operate in a stall condition is the possibility of overpressuring the system and causing a hose or fitting to leak or rupture. Additionally, the need to have the motor operating continuously not only unnecessarily consumes energy but also requires the motor to be more rugged and expensive than a motor operated intermittently.

The present disclosure addresses these and related problems.

SUMMARY

A paint circulation system includes a paint reservoir, a pressure transducer, a servo motor driven pump, an electronic servo drive and controller, one or more, typically robotic, paint applicators in a spray booth and an isolation valve. The pressure transducer provides a signal to the controller and servo drive indicating the current pressure in the system. The servo pump is controlled by the controller and servo drive, draws paint from the reservoir and maintains the desired pressure in the system. Alternatively, the controller and servo drive may maintain a constant speed of the servo motor and pump. The isolation valve is downstream from the applicators and is closed when paint is requested by the applicators. When paint is flowing to the applicators, the servo drive adjusts pump speed to maintain the desired system pressure as sensed by the pressure transducer. When paint is not requested, the isolation valve is open and the servo pump motor operates to provide a predetermined minimum flow rate to circulate paint from, and return it to, the reservoir. A pressure relief valve disposed between the output of the servo pump and the paint reservoir relieves excess pressure in the system.

Thus it is an aspect of the disclosed embodiment to provide a paint circulation system for use with vehicle paint spray booths.

It is a further aspect of the disclosed embodiment to provide a paint circulation system having a pressure transducer, an electronic servo drive and a servo motor powered pump.

It is a still further aspect of the disclosed embodiment to provide a paint circulation system having a paint reservoir, a servo motor driven pump, one or more paint applicators and an isolation valve.

It is a still further aspect of the disclosed embodiment to provide a paint circulation system having a paint reservoir, a pressure transducer, a servo motor driven pump, one or more paint applicators and an isolation valve.

It is a still further aspect of the disclosed embodiment to provide a paint circulation system having a paint reservoir, a servo motor driven pump, one or more paint applicators, an isolation valve and a pressure relief valve.

It is a still further aspect of the disclosed embodiment to provide a paint circulation system having a servo motor driven pump, one or more paint applicators and an isolation valve which is closed when the applicators request paint and open when paint is not requested.

It is a still further aspect of the disclosed embodiment to provide a paint circulation system having pressure transducer, an electronic servo drive, a servo motor powered pump and one or more paint applicators which maintain a first pressure or constant speed in the system when the applicators request paint and a second pressure or constant speed when paint is not requested.

Further aspects, advantages and areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
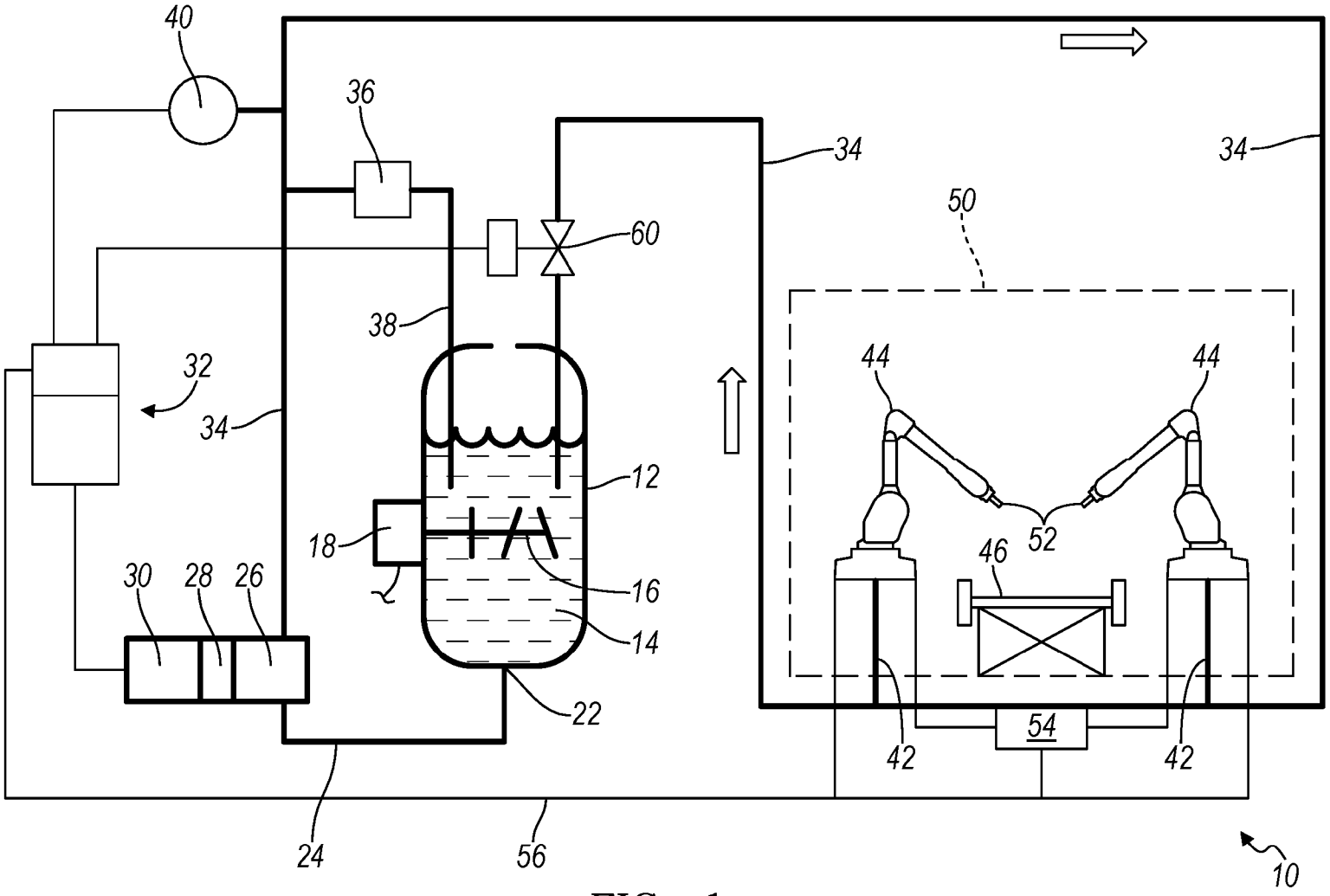
FIG. 1 is a schematic diagram of a paint circulation system according to the disclosed embodiment.

With reference to FIG. 1, a paint circulation system according to the disclosed embodiment is illustrated and generally designated by the reference number 10. The paint circulation system 10 includes an open paint tank or reservoir 12 which holds a supply of a particular type or color of paint 14 which may be either water or solvent based. Typically, the tank or reservoir 12 includes an agitator 16 which continuously stirs or agitates the paint 14 in the tank or reservoir 12. The agitator 16 is preferably powered by a variable speed electric motor 18.

The tank or reservoir 12 includes a bottom outlet 22 which communicates through a line, pipe or hose 24 with the inlet of a positive displacement pump 26 such as a multiple piston pump or other design wherein flow rate is proportional to motor speed. The positive displacement pump 26 is driven through a speed reducing gearbox 28 by a servo motor 30 which is, in turn, controlled by an electronic servo drive and system controller 32. The servo motor 30 is preferably an explosion proof design having a power output in the range of 3 to 5 kW (4 to 6 hp.) but may be more or less depending upon the size of the installation. The output speed of the gearbox 28 is preferably between 0 and 40 r.p.m., though higher output speeds may be suitable for certain installations. The positive displacement pump 26 preferably has an output of between 0 to about 60 liters per minute though, again, a larger output may be suitable for certain installations.

The output of the positive displacement pump 26 is provided to a line, pipe or hose 34 which communicates with a passive pressure relief valve 36 which automatically relieves pressure in the system 10, should it rise above a predetermined value, and returns paint 14 through a line, pipe or hose 38 to the tank or reservoir 12. The line, pipe or hose 34 also communicates with a pressure transducer 40 which supplies a real time, proportional electrical signal indicating the fluid pressure in the line, pipe or hose 34 to the electronic servo drive and system controller 32. The line, pipe or hose 34 also communicates and supplies paint under pressure through branch lines or hoses 42 to one or more, and typically several robotic paint applicators 44.

The robotic paint applicators 44 may be any one of several commercially available, multiple axis devices which are controlled by application, i.e., vehicle or other items, specific spraying programs and are preferably arranged on opposite sides of a vehicle conveyor 46 or in any other suitable arrangement in a spray booth 50. The conveyor 46 translates vehicles, items or components to be painted past the robotic paint applicators 44. The paint applicators 44 may include small chargeable canisters or reservoirs (not illustrated) or they may provide the paint 14 directly to one or more spray nozzles 52.

It should be understood that a single robotic paint applicator 44 or, more typically, a plurality thereof may be utilized with the disclosed embodiment in an individual spray booth 50. Spray booth and paint mix electronic controllers 54 monitor the job queue for color requirements and provide signals to the robotic paint applicators 44 and to the controller portion of the electronic servo drive and system controller 32, either through an electrical circuit 56 or a wireless connection, that a painting cycle is beginning and that the paint applicators 44 will require and consume paint 14 as well as other information. This signal in the circuit 56 or wireless connection may continue for the duration of the paint cycle and may terminate when the active supply of paint 14 is no longer required or may provide a pulse or signal commanding termination of flow of paint 14.

Finally, the line, pipe or hose 34 includes a two position isolation valve 60 which provides an interruptible return flow path for the paint 14 to the tank or reservoir 12. The isolation valve 60 is controlled by the electronic servo drive and system controller 32 and is closed when the robotic applicators 44 are requesting paint 14 and is open when they are not. The isolation valve 60 may be any type of valve such as a pinch valve, solenoid valve or pneumatically operated valve capable of selectively allowing and fully interrupting flow of paint 14 in the line, pipe or hose 34.

Figure 2:
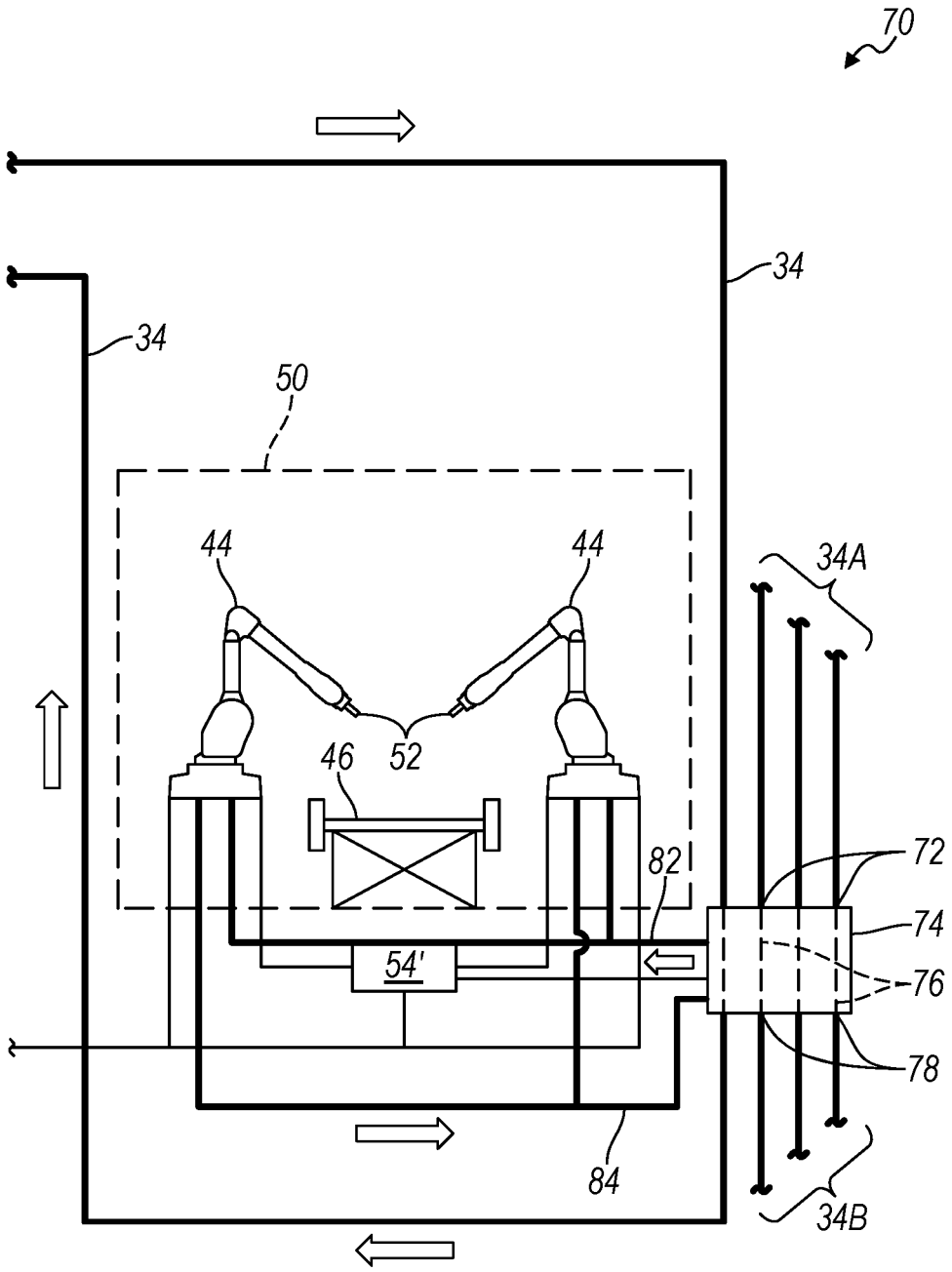
FIG. 2 is a partial schematic diagram of a paint circulation system according to the disclosed embodiment illustrating alternative and additional components.

Referring now to FIG. 2, an alternative configuration of the system 10 relating particularly to the components associated with the spray booth 50 is illustrated and generally designated by the reference number 70. The alternative system 70 includes all the components illustrated to the left in FIG. 1 described above and is fed paint 14 in the line, pipe or hose 34 which also returns paint 14 to the isolation valve 60. The alternative system 70 also includes the spray booth 50, the robotic applicators 44, the spray nozzles 52, the vehicle conveyor 46 and a modified or enhanced electronic controller 54'.

The line, pipe or hose 34 is but one of a plurality of supply lines, pipes or hoses 34A which provide a selection of various colors of paint from a plurality of paint supply systems to a plurality of separate (isolated) inputs 72 of a color selection manifold 74 under the control of the electronic controller 54'. The color selection manifold 74 includes through passageways 76 communicating with a corresponding plurality of separate (isolated) outputs 78 which are connected to a corresponding plurality of return lines, pipes or hoses 34B. The color selection manifold 74 selects one of the paints 14 in the lines 34 and 34A and provides it to an outlet line, pipe or hose 82. Paint 14 in a separate return line, pipe or hose 84 is routed back to the same line, pipe or hose 34 and 34B by the color selection manifold 74 while the remaining, unselected colors of paint 14 pass directly through the color selection manifold 74. It should be appreciated that the location of the color selection manifold 74, to one side of the spray booth 50, is by way of example and for purposes of clarity and that the actual location may be otherwise, for example, on the arms of or closely associated with the robotic paint applicators 44. It will also be appreciated that each such paint supply system for each color in each of the lines, pipes and hoses 34A and 34B includes those components illustrated to the left in FIG. 1, as noted above.

The outlet line, pipe or hose 82 from the color selection manifold 74 containing the current selected color of paint 14 provides such paint 14 to each of the robotic applicators 44. The separate return line, pipe or hose 84 carries paint 14 from the robot applicators 44 to a return inlet of the color selection manifold 74. As stated above, the flow of those unselected colors of paint 14 continues, uninterrupted through the passageways 76 of the color selection manifold 74 while one color has been selected and, in fact, when no color is selected, the color selection manifold 74 provides through flow of all the paints 14. It should be appreciated that one or both of these alternate configurations, namely, the paint selection manifold 74 and the separate supply and return lines 82 and 84 may be utilized with the paint circulation system 10 components illustrated in FIG. 1.

Figure 3:
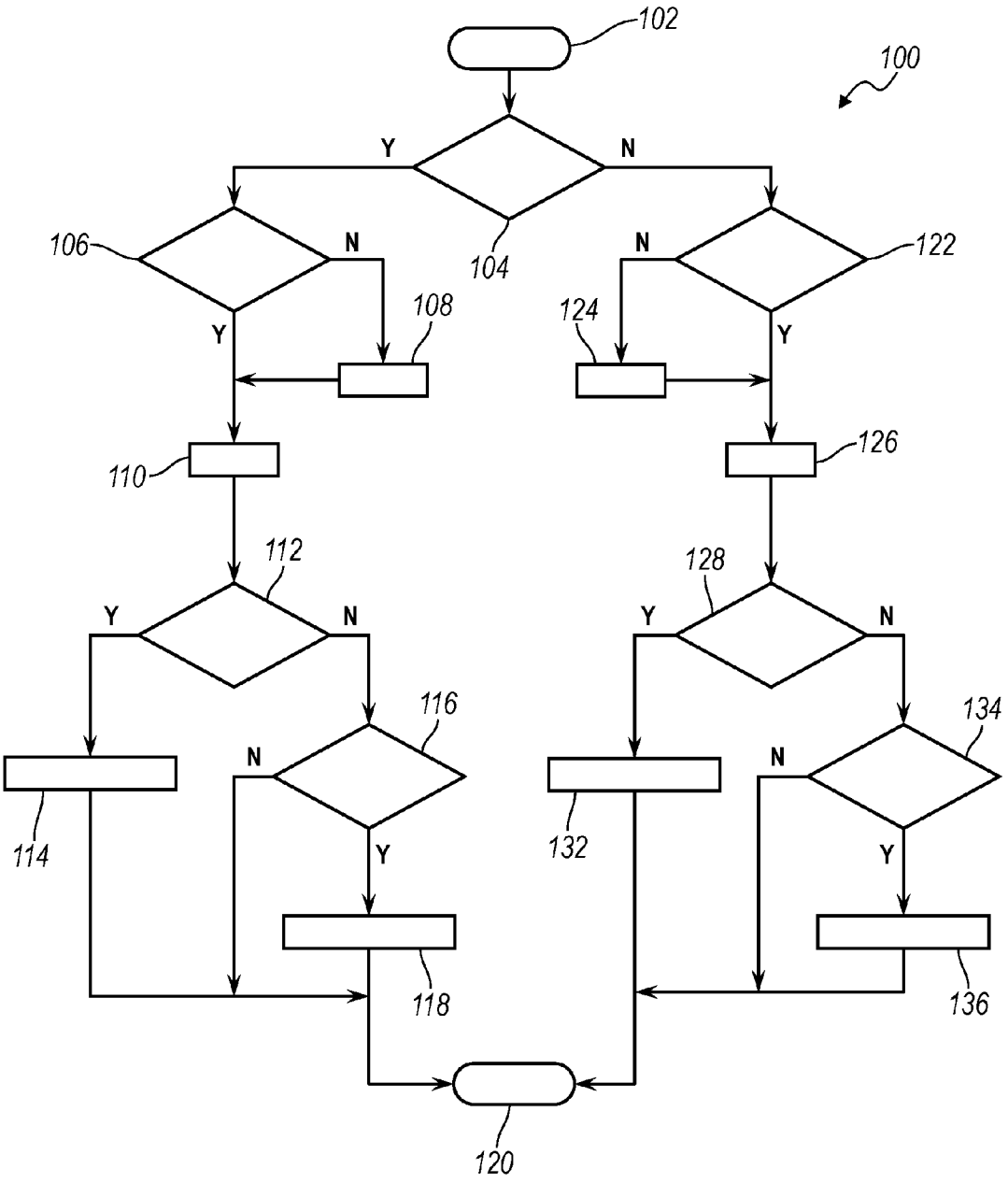
FIG. 3 is a flow chart detailing the method of operation of a paint circulation system according to the disclosed embodiment.

Referring now to FIG. 3, a flowchart of the program or method of operation of the paint circulation system 10 is illustrated and generally designated by the reference number 100. The method of operation 100 is preferably a series of instructions embodied in an algorithm stored in the controller portion of the electronic servo drive and system controller 32. The method of operation 100 begins with an initializing step 102 which clears and resets registers and data and moves to a decision point 104 which inquires whether there is an active paint request signal, either in the circuit 56 or wirelessly delivered to the controller portion of the electronic servo drive and system controller 32. If there is, the decision point 104 is exited at YES and the method 100 moves to a second decision point 106 which inquires whether the isolation valve 60 is closed. If it is not, the second decision point 106 is exited at NO and a first process step 108 is encountered that commands closure of the isolation valve 60. If the isolation valve 60 is closed, the second decision point 106 is exited at YES.

After this action or the first process step 108, the method 100 moves to a second process step 110 which reads the current pressure in the line, pipe or hose 34 which is the output pressure of the servo driven, positive displacement pump 26 as sensed by the pressure transducer 40. The method 100 then moves to a third decision point 112 which inquires or determines whether the current sensed pressure in the line, pipe or hose 34 is less than the desired minimum paint spraying pressure, that is, the minimum pressure necessary to properly supply paint 14 to the robotic paint applicators 44. If the current pressure is less than the desired minimum pressure, the third decision point 112 is exited at YES and the method 100 moves to a third process step 114 that increments or increases the speed of the servo motor 30 and thus increases the output flow and pressure of the positive displacement pump 26. If the current pressure is more than the desired minimum pressure, the third decision point 112 is exited at NO and the method 100 moves to a fourth decision point 116 that inquires whether the current pressure is more than the maximum desired pressure in the line, pipe or hose 34. If it is not, the fourth decision point 116 is exited at NO and the method 100 moves to an end or termination point 120. The program or method 100 may then be repeated at any desired iteration or repetition rate. If the sensed pressure is above the maximum desired pressure, the fourth decision point 116 is exited at YES and the method 100 encounters a fourth process step 118 that decrements or decreases the speed of the servo motor 30 and thus decreases the output flow and pressure of the positive displacement pump 26.

It will thus be appreciated that the just described steps of the method 100 envision a dead band or null region of pressure between a minimum predetermined pressure and a maximum predetermined pressure which have been found suitable and which ensure proper delivery of paint 14 in a particular installation. It should thus also be appreciated that the third and fourth decision points 112 and 116 may be combined into a single decision point wherein it is determined whether the current pressure of the paint 14 in the line, pipe or hose 34 is below the minimum pressure in which case the speed of the servo motor 30 is incremented or increased, is in a dead band or null region between the minimum and maximum pressures in which case no action is taken, or is above the maximum pressure in which case the speed of the servo motor 30 is decremented or decreased.

As stated previously, control of the servo motor 30 and the positive displacement pump 26, in addition, to control of pressure when the robotic applicators 44 are applying paint 14, as described above, may also be controlled by speed for maintaining minimal circulation when paint is not being applied, as described below.

Returning to the first decision point 104, as noted above, it inquires whether there is an active paint request signal, either in the circuit 56 or wirelessly delivered to the controller portion of the electronic servo drive and system controller 32. If there is not, the decision point 104 is exited at NO and the method 100 moves to a fifth decision point 122 which inquires whether the isolation valve 60 is open. If it is not, the fifth decision point 122 is exited at NO and a fifth process step 124 commands the isolation valve 60 to open. If the isolation valve 60 is open, the fifth decision point 122 is exited at YES. In either case, the method 100 then encounters a sixth process step 126 which reads the current pressure in the line, pipe or hose 34 as sensed by the pressure transducer 40.

The method 100 then moves to a sixth decision point 128 which inquires whether the current sensed pressure in the line, pipe or hose 34 is less than the desired minimum paint circulation pressure, that is, the minimum pressure necessary to properly circulate paint 14 in the line, pipe or hose 34 when the robotic paint applicators 44 are quiescent. If the current pressure is less than the desired minimum circulation pressure, the sixth decision point 128 is exited at YES and the method 100 moves to a seventh process step 132 that increments or increases the speed of the servo motor 30 and thus increases the output flow and pressure of the positive displacement pump 26. If the current pressure is more than the desired minimum circulation pressure, the sixth decision point 128 is exited at NO and the method 100 moves to a seventh decision point 134 that inquires whether the current pressure is more than the maximum desired circulation pressure in the line, pipe or hose 34. If it is not, the seventh decision point 116 is exited at NO and the method 100 moves to the end or termination point 120. If the pressure sensed in the sixth process step 126 is above the maximum desired circulation pressure, the seventh decision point 134 is exited at YES and the method 100 moves to an eighth process step 136 that decrements or decreases the speed of the servo motor 30 and thus decreases the output flow and pressure of the positive displacement pump 26. The method 100 then, again, terminates and the end step 120.

Once again, it should be appreciated that the difference between the minimum and maximum circulation pressures referenced in the sixth and seventh decision points 128 and 134 represent a dead band or null region which includes pressures which have been found to provide suitable circulation of the paint 14. Also again, it should be understood that these two decision points may be combined into a single decision point in which it is determined whether the current circulation pressure of the paint 14 in the line, pipe or hose 34 is below the minimum desired or necessary pressure in which case the speed of the servo motor 30 is incremented or increased, is in a dead band or null region between the minimum and maximum circulation pressures in which case no action is taken, or is above the maximum desired or necessary pressure in which case the speed of the servo motor 30 is decremented or decreased.

It should be appreciated that the paint circulation system 10 illustrated in FIG. 1 will typically be but one of several such systems, under the control of a master programmable logic controller (PLC) (not illustrated), which share and operate within a single spray booth 50 and which supply various colors of paint 14 to a manifold (also not illustrated) controlled by the master PLC which selects and provides a desired paint color to the robotic paint applicators 44. In addition to controlling the paint selection manifold, after it commands a color change, the master PLC commands a brief purge of the previous paint color through the paint applicators 44 to ensure the newly selected color is pure and uncontaminated by the previous paint color.

In addition to improved delivery of paint 14 through the improved control of pressure and flow provided by the instrumentation, servo motor 30 and the electronic servo drive and system controller 32, the use of the latter components provides the capability to monitor torque supplied or delivered by the servo motor 30 to the positive displacement pump 26 which, in turn, enables or permits continuous monitoring of the viscosity of the paint 14. This represents a marked improvement over viscosity measurements in the past which were typically undertaken manually on a once per shift schedule.

Furthermore, since the system 10 has the ability of monitor speed, applied torque and power consumption, it provide the capability to determine that the paint 14 in the system 10 has sheared down to a stable viscosity after a period of non-circulation. Finally, monitoring the speed of the servo motor 30 during the time the isolation valve 60 is closed provides real time data regarding the volume of paint 14 being consumed by the spray process. Such information is useful for maintaining and improving production processes and important for environmental considerations.

Although the foregoing description has been concerned with and has disclosed the embodiment in connection with the supply of paint to a vehicle paint spray booth, it should be understood that the disclosed embodiment is equally well suited and usable to deliver other fluids, mastic, sealers, adhesives and similar materials to production line application stations for passengers cars, trucks, sport utility vehicles, recreational vehicles, mobile homes and other types of vehicles.

The foregoing description is merely exemplary in nature and variations that do not depart from its gist are intended to be within the scope of the following claims. Such variations are not to be regarded as a departure from the spirit and scope of either the foregoing disclosure or the following claims.

What is claimed is:

1. A fluid circulation and application system comprising, in combination, a fluid reservoir, a positive displacement pump having an input in communication with the fluid reservoir and a fluid output, a servo motor and gear box having an output driving the positive displacement pump, a pressure transducer for sensing a pressure of the fluid output and providing an output signal, a servo drive and controller having an input coupled to the output signal and an electrical output driving the servo motor, at least one multiple axis, robotic fluid applicator in fluid communication with the fluid output of the positive displacement pump, and a two position isolation valve disposed between the fluid output of the positive displacement pump and the fluid reservoir for selectively permitting and inhibiting return fluid flow to the fluid reservoir by control of the servo drive and controller.

2. The fluid circulation and application system of claim 1 wherein the fluid reservoir includes a fluid agitator.

3. The fluid circulation and application system of claim 1 further including a conveyor disposed adjacent the at least one fluid applicator.

4. The fluid circulation and application system of claim 3 further including a spray booth and wherein the at least one fluid applicator and the conveyor are disposed in the spray booth.

5. The fluid circulation and application system of claim 1 further including a pressure relief valve operably disposed between the fluid output of the positive displacement pump and the fluid reservoir.

6. The fluid circulation and application system of claim 1 wherein the fluid is one of paint, mastic, a sealer and an adhesive.

7. A paint circulation and application system comprising, in combination, a paint reservoir, a positive displacement pump having an input in communication with the paint reservoir and an output, a servo motor and gear box driving the positive displacement pump, a pressure transducer for sensing a pressure of the output of the positive displacement pump and providing a signal, a servo drive and controller having an input coupled to the signal and an electrical output driving the servo motor, at least one multiple axis, robotic paint applicator in fluid communication with the output of the positive displacement pump, and a return flow isolation valve disposed between the output of the pump and the paint reservoir for selectively inhibiting return paint flow to the paint reservoir by control of the servo drive and controller.

8. The paint circulation and application system of claim 7 wherein the paint reservoir includes a paint agitator.

9. The paint circulation and application system of claim 7 further including a conveyor disposed adjacent the at least one robotic paint applicator.

10. The paint circulation and application system of claim 9 further including a spray booth and wherein the at least one robotic paint applicator and the conveyor are disposed in the spray booth.

11. The paint circulation and application system of claim 7 further including a pressure relief valve operably disposed between the output of the positive displacement pump and the paint reservoir.

12. The paint circulation and application system of claim 7 wherein the servo motor is a multiple horsepower motor.

13. A fluid circulation and application system comprising, in combination, a fluid reservoir, a servo motor driving a speed reducing gear box, the gear box having an output, a piston pump driven by the output of the gear box having a fluid input in communication with the fluid reservoir and a fluid output, a pressure transducer for sensing a pressure of the fluid output and providing a pressure signal, a servo drive and controller having an input receiving the pressure signal and an electrical output driving the servo motor, at least one multiple axis, robotic fluid applicator having a nozzle in fluid communication with the fluid output of the pump, and a two position return flow isolation valve operably disposed between the fluid output of the piston pump and the fluid reservoir for preventing return fluid flow to the fluid reservoir when the robotic fluid applicator is operating, the isolation valve being controlled by the servo drive and controller.

14. The fluid circulation and application system of claim 13 wherein the fluid reservoir includes a fluid agitator.

15. The fluid circulation and application system of claim 13 further including a conveyor disposed adjacent the at least one robotic fluid applicator.

16. The fluid circulation and application system of claim 15 further including a spray booth and wherein the at least one robotic fluid applicator and the conveyor are disposed in the spray booth.

17. The fluid circulation and application system of claim 13 further including a pressure relief valve operably disposed between the fluid output of the pump and the fluid reservoir.

18. The fluid circulation and application system of claim 13 wherein the fluid is one of paint, mastic, a sealer and an adhesive.

* * * * *